United States Patent [19]

Jackson

[11] Patent Number: 5,006,028

[45] Date of Patent: Apr. 9, 1991

[54] CAM LIFT AND CARRY PARTS TRANSFER APPARATUS

[76] Inventor: Donald T. Jackson, 1159 Ashley, Troy, Mich. 48098

[21] Appl. No.: 525,459

[22] Filed: May 18, 1990

[51] Int. Cl.[5] ..... B65G 25/04

[52] U.S. Cl. ..... 414/222; 198/468.2; 198/468.6; 198/621; 414/751; 414/626

[58] Field of Search ..... 414/626, 630, 594, 222, 414/225, 749, 751; 198/468.2, 468.6, 774.4, 621

[56] References Cited

U.S. PATENT DOCUMENTS

| | | | |
|---|---|---|---|
| 3,178,040 | 4/1965 | Nelson | 214/1 |
| 3,850,285 | 11/1974 | Johnson | 414/626 X |
| 4,030,614 | 6/1977 | Taneda et al. | 414/751 X |
| 4,032,018 | 6/1977 | Wallis | 214/1 BB |
| 4,095,699 | 6/1978 | O'Neil | 198/468.2 X |
| 4,407,630 | 10/1983 | Toda | 414/786 |
| 4,428,221 | 1/1984 | Owens | 75/405 |
| 4,566,306 | 1/1986 | Orii | 72/346 |
| 4,627,783 | 12/1986 | DeFilippi | 414/517 |
| 4,637,243 | 1/1987 | Bond | 72/421 |
| 4,653,311 | 3/1987 | Tack, Jr. | 72/443 |
| 4,693,361 | 9/1987 | Baba | 198/621 |
| 4,727,976 | 3/1988 | Tsuchiya et al. | 198/403 |
| 4,762,460 | 8/1988 | Stoll | 198/468.2 X |
| 4,833,908 | 5/1989 | Sofy | 72/405 |
| 4,921,387 | 5/1990 | Bennington | 198/468.6 X |

FOREIGN PATENT DOCUMENTS

| | | | |
|---|---|---|---|
| 46371 | 10/1986 | Japan | 198/774.4 |
| 663636 | 5/1979 | U.S.S.R. | 198/774.4 |
| 734092 | 5/1980 | U.S.S.R. | 198/774.4 |
| 1560752 | 2/1980 | United Kingdom | 198/774.4 |

*Primary Examiner*—David A. Bucci
*Assistant Examiner*—James T. Eller, Jr.
*Attorney, Agent, or Firm*—Basile and Hanlon

[57] ABSTRACT

A parts transfer apparatus for progressively advancing workpieces through successive work stations. A frame is movably mounted within a surrounding, rigid, support structure. Workpiece engaging devices are mounted on the frame for engaging a workpiece in each work station. Pairs of cams are fixedly mounted on the support structure and disposed on opposite sides of the frame to define a reciprocal path of movement for the frame. Cam followers mounted on the frame engage and move along the pairs of cams. A drive mechanism, preferably in the form of opposed acting fluid cylinders, is coupled between the support structure and the frame for reciprocatingly driving the frame between the first and second ends of the support structure.

5 Claims, 6 Drawing Sheets

CAM LIFT AND CARRY PARTS TRANSFER APPARATUS

BACKGROUND OF THE INVENTION

1. Field of the Invention

The present invention relates to parts transfer apparatus for conveying parts or workpieces between adjacent work stations in manufacturing operations.

2. State of the Art

Parts transfer apparatus, such as conveyors, shuttles, etc., are frequently employed in manufacturing operations to convey parts or workpieces between adjacent work stations. Such work stations could be tools, welding presses, stamping presses, etc. Further, one or more idle stations may be provided between each tool or press.

A common parts transfer apparatus is a lift and carry shuttle. Such a lift and carry shuttle includes reciprocating shuttle rails on which various grippers, clamps and locators are mounted for engaging a part or workpiece in one work station and advancing the part or workpiece to the next succeeding work station as the rails are advanced in a forward direction. The rails and the tools or presses are designed such that the rails reciprocally extend through or between such tools or presses. One or more lifter units are connected to the shuttle rails and operate to raise the shuttle rails upward from a lower position to engage a workpiece in a tool or press before the shuttle rail drive is activated to advance the rails in a forward direction to move the workpiece from one tool or press and advance it and all other workpieces on the shuttle rails to the next, adjacent work stations or to an intermediate idle station. At the end of such forward travel, the lifter units retract to lower the shuttle rails to a parts setdown position. The shuttle rails then retract to the start position for the next cycle of operation.

Such lift and carry shuttles include separate drive means, such as motors, fluid operated cylinders, etc., to reciprocate the shuttle rails and to raise and lower the shuttle rails during each cycle of operation. These separate drive units increase the cost of the overall lift and carry shuttle.

Thus, it would be desirable to provide a lift and carry parts transfer apparatus or shuttle having a simplified drive means for a low manufacturing cost. It would also be desirable to provide a lift and carry parts transfer apparatus which can be easily designed for different parts pickup and parts setdown heights.

SUMMARY OF THE INVENTION

The present invention is a cam lift and carry parts transfer apparatus for advancing parts or workpieces between adjacent work stations in a manufacturing operation. A rigid support structure having first and second ends surrounds one or more work stations and the parts transfer apparatus. A frame is movably disposed within the rigid support structure. Workpiece engaging means are mounted on the frame for engaging a workpiece. Cam means fixedly mounted on the support structure are disposed on opposite sides of the frame and define a reciprocal path of movement for the frame. Cam follower means are mounted on the frame and engage the cam means. Finally, the parts transfer apparatus includes drive means, coupled to the support structure and the frame, for reciprocating the frame between the first and second ends of the support structure.

In a preferred embodiment, the cam means comprises a first pair of identically-shaped cams disposed on opposite sides of one end of the frame. The cam means also includes a second pair of identically-shaped cams disposed on opposite sides of the other end of the frame. Each of the cams of the second pair of cams is linearly arranged end-to-end with one cam of the first pair of cams. The second pair of cams are identically shaped as the first pair of cams. Each of the cams of the first and second pairs of cams preferably comprises a first inclined portion extending upwardly from a first end. A second linear portion extends substantially horizontally from a second end of the first inclined portion. A third inclined portion extends downwardly from an opposite end of the second horizontal portion.

Preferably, the cam follower means comprises a first pair of rollers mounted on opposite sides of a first end of the frame. A second pair of rollers are mounted on opposite sides of the second end of the frame. The first pair of rollers movably engage the first pair of cams and the second pair of rollers movably engage the second pair of cams.

The drive means preferably comprises first and second fluid operated cylinders, each having an extensible and retractable cylinder rod movably extending therefrom. The first and second cylinders are mounted on a first movable cart movably engaging a rigid platform connected to the support structure. The first and second fluid cylinders are oriented in opposite directions, with the cylinder rod of the first cylinder being fixedly connected to the rigid support structures surrounding the movable frame. The end of the second cylinder is fixedly connected to a second movable cart also movably engaging the rigid platform.

At least one counterbalance cylinder is mounted to the frame and has a reciprocal cylinder rod extending therefrom and connected to the second cart. Guide means are mounted at each end of the second cart to guide the vertical movement of the frame via rollers mounted on the frame and engaging the guide means.

The cam lift and carry parts transfer apparatus of the present invention provides advance of workpieces between successive work stations at a lower cost than previously devised lift and carry shuttle-type parts transfer apparatus utilizing separate drive motors to reciprocate, and raise and lower the shuttle rails. Further, the cams employed in the present parts transfer apparatus may be easily modified to provide any desired path of movement of the workpieces between succeeding work stations. Further, the cams may be easily designed with different parts pickup and parts setdown heights to add to the versatility of application of the present parts transfer apparatus.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
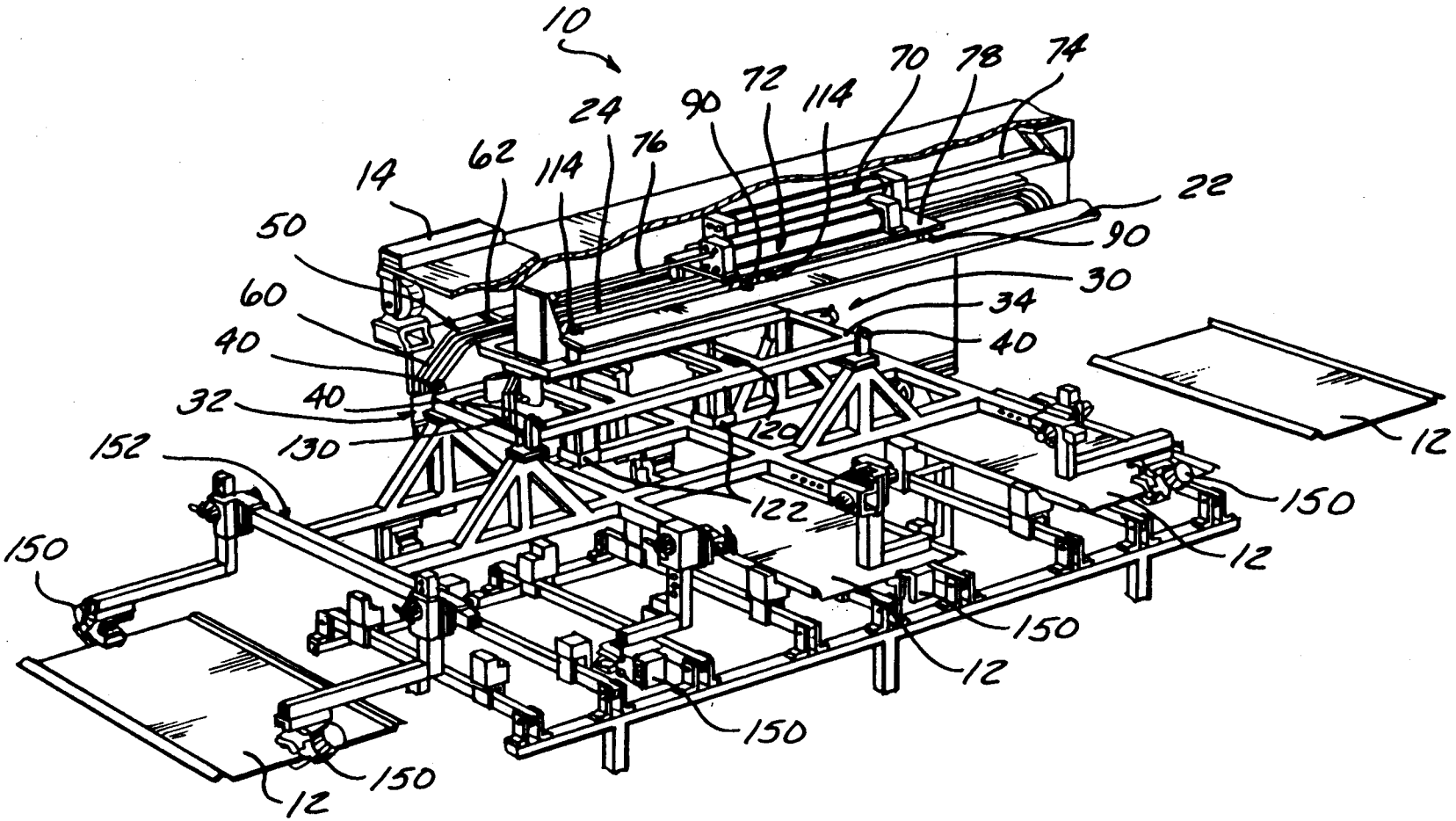
FIG. 1 is a perspective view of the cam lift and carry parts transfer apparatus of the present invention.

Throughout the following description and drawing, an identical reference number is used to refer to the same component shown in multiple figures of the drawing.

Figure 4:
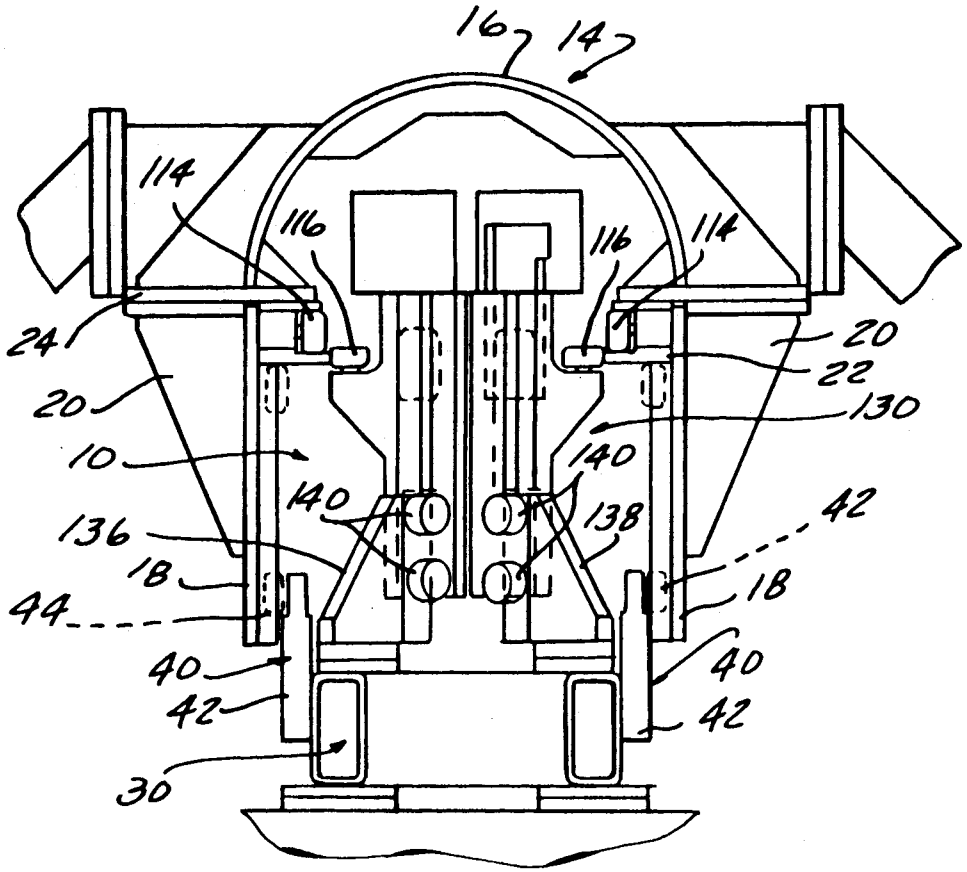
FIG. 4 is a left hand end view of the parts transfer apparatus shown in FIG. 1.

Referring now to the drawing, and to FIG. 1 in particular, there is illustrated a cam lift and carry parts transfer apparatus 10 which moves parts or workpieces 12 through successive work stations in a manufacturing operation. As shown in FIGS. 1 and 4, a rigid support structure surrounds the movable elements of the parts transfer apparatus 10 and provides a stationary structure for mounting such movable components thereon. The rigid support structure denoted by reference number 14 in FIG. 4 includes an arcuate shaped housing 16 which is disposed above the lift and carry parts transfer apparatus 10. The housing 16 includes depending legs 18 which are disposed at opposite ends and at a central, intermediate portion, as shown more clearly in FIG. 5. The depending legs 18 may be interconnected via suitable struts or reinforcing members 20 to framework surrounding and attached to the housing 16.

The support structure 14 may be freestanding and secured in place to the floor or surrounding stationary structure in a manufacturing facility. Alternately, the entire support structure 14 may be provided with casters or rollers on legs, not shown, to enable the support structure 14 to be moved out of position for changeover, etc.

A platform formed of first and second, substantially horizontally extending platform members 22 and 24 is mounted on opposite sides of the support 14 and secured to the depending legs 18 of the support 14.

The parts transfer apparatus 10 also includes a rigid frame 30 formed of a planar assembly of interconnected tubular members. The frame 30 has a first end 32 and a second end 34. Cam follower means denoted in general by reference number 40 are fixedly connected to each of the first and second ends 32 and 34 of the frame 30 and are disposed on opposite sides of the first and second ends 32 and 34 of the frame 30. As shown more clearly in FIG. 4, each of the cam follower means 40 comprises a bracket 42 attached at one end to the frame 30. A roller 44 is rotatably mounted to the other end of the bracket 42.

The cam follower means 40, and particularly the rollers 44, engage cam means fixedly mounted to the support structure 14 and disposed on opposite sides of the frame 30. The cam means defines a reciprocal path of movement for the frame 30. The movement of the cam follower means 40 along the cam means creates the desired lift and carry motion of the frame 30 to raise the workpieces 12 from a lowered, parts pickup position to a transfer height and advance the workpieces 12 to the next succeeding work station wherein the workpieces 12 are lowered to a part setdown height before the frame 30 moves in a reciprocal path of movement to the start position.

Figure 5:
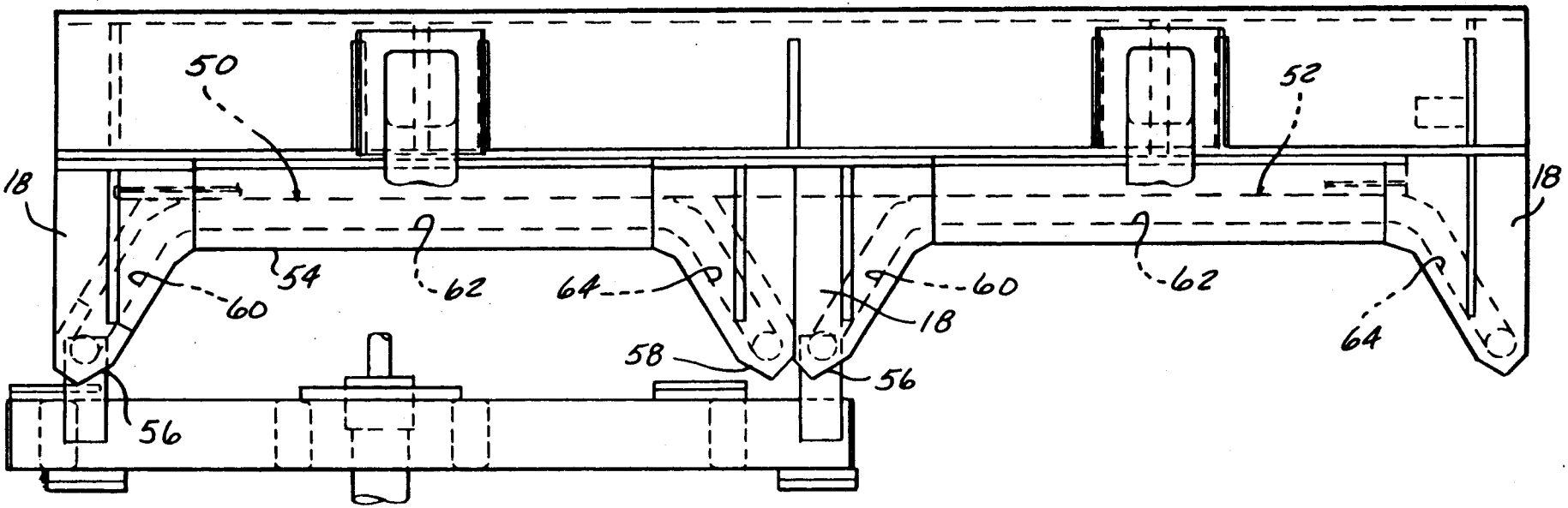
FIG. 5 is a front elevational view of a portion of the cam means employed in the parts transfer apparatus of the present invention.

In a preferred embodiment, the cam means preferably comprises a first pair of identically-shaped cams 50, only one of which is shown in FIGS. 1 and 5. The cam means also includes a second pair of cams 52 which are also identically shaped and disposed on opposite sides of the frame 30 adjacent an opposite end of the frame 30. The second cams 52 are identical to the first cams 50 in shape and are arranged linearly end-to-end as shown in FIG. 5.

Since each of the cams 50 and 52 is identically constructed, the following description will be provided with respect to only one of the cams 50. It will be understood that the same description follows for the remaining cams 50 and 52. As shown in FIG. 5, the cam 50 is formed in a linear plate member 54 having a first end 56 and an opposed, spaced second end 58. The plate 54 is secured at the first and second ends 56 and 58, respectively, to the depending legs 18 of the rigid support structure 14.

The cam means 50 includes a first inclined portion 60 extending upwardly at a predetermined angle from the first end 56. The first inclined portion 60 has a generally linear form and is oriented so as to extend upward from the first end 56 in the orientation shown in FIG. 5. Preferably, the upward inclined angle of the first inclined portion 60 is approximately 60° with respect to horizontal.

The first inclined portion 60 smoothly communicates with one end of a second horizontally extending, linear portion 62. The second linear portion 62 extends longitudinally along the support structure 14 and smoothly terminates in a third inclined portion 64. The third inclined portion 64 has a generally linear shape extending from the second linear portion to the second end 58 of the cam 50. The third inclined portion 64 is disposed at a predetermined angle, such as approximately 60° with respect to the horizontal, and inclines downwardly from the second linear portion 62.

It should be noted that while the first and third inclined portions 60 and 64, respectively, each have a linear shape, they may have the same or different lengths depending upon the particular application of the parts transfer apparatus 10 of the present invention. As further shown in FIG. 5, the first end 56 of each of the second pair of cams 52 is located adjacent to the second end 58 of one of the first cam 50.

The cam lift and carry parts transfer apparatus 10 also includes drive means, coupled to the support structure 14 and the frame 30, for reciprocatingly moving the frame 30 between the first and second ends of the rigid support structure 14. In a preferred embodiment shown in FIGS. 1, 2, 3 and 6, the drive means comprises first and second fluid operated cylinders 70 and 72, respectively, each having an outwardly extending, extensible and retractable cylinder rod moved by a piston slidably mounted within each cylinder 70 and 72. The first cylinder 70 has an extensible and retractable first cylinder rod 74; while the second cylinder 72 has a second cylinder rod 76 movably extending outward therefrom. The fluid operated cylinder 70 and 72 may be conventionally constructed and may operate with hydraulic or air fluids.

The first and second cylinders 70 and 72 are mounted on a first cart 78. The first cart 78 is formed of an interconnected arrangement of spaced tubular members 80 and 82 and end mounting plates 84 and 86. The ends of the cylinders 70 and 72 are fixedly connected by suitable fasteners to the end mounting plates 84 and 86.

Pairs of rollers, each comprising a vertically oriented roller 90 and a horizontally mounted roller 92 are mounted at each corner of the first cart 78. The rollers 90 and 92 slidably engage the platform members 22 and 24 on the rigid support structure 14 to control the bidirectional sliding movement of the first cart 78. Each of the rollers 90 and 92 is connected to the first cart 78 via suitable mounting brackets or plates as shown in FIG. 6.

The first and second cylinders 70 and 72, respectively, are oriented in opposite directions on the first cart 78 such that the first cylinder rod 74 of the first cylinder 70 extends outward in one direction from one end of the first cart 78; while the second cylinder rod 76 of the second cylinder 72 extends outward in an opposite direction from the opposite end of the first cart 78.

Figure 2:
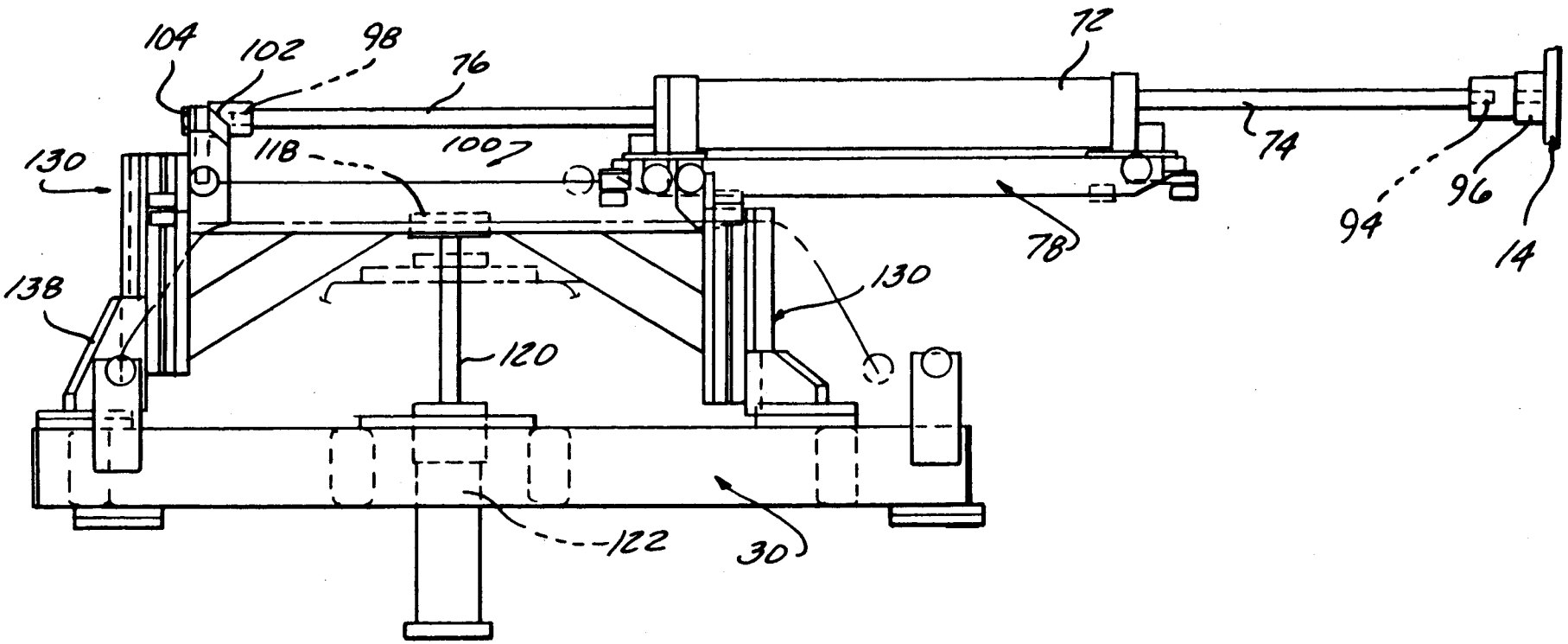
FIG. 2 is a front elevational view of the parts transfer apparatus shown in FIG. 1.
Figure 3:
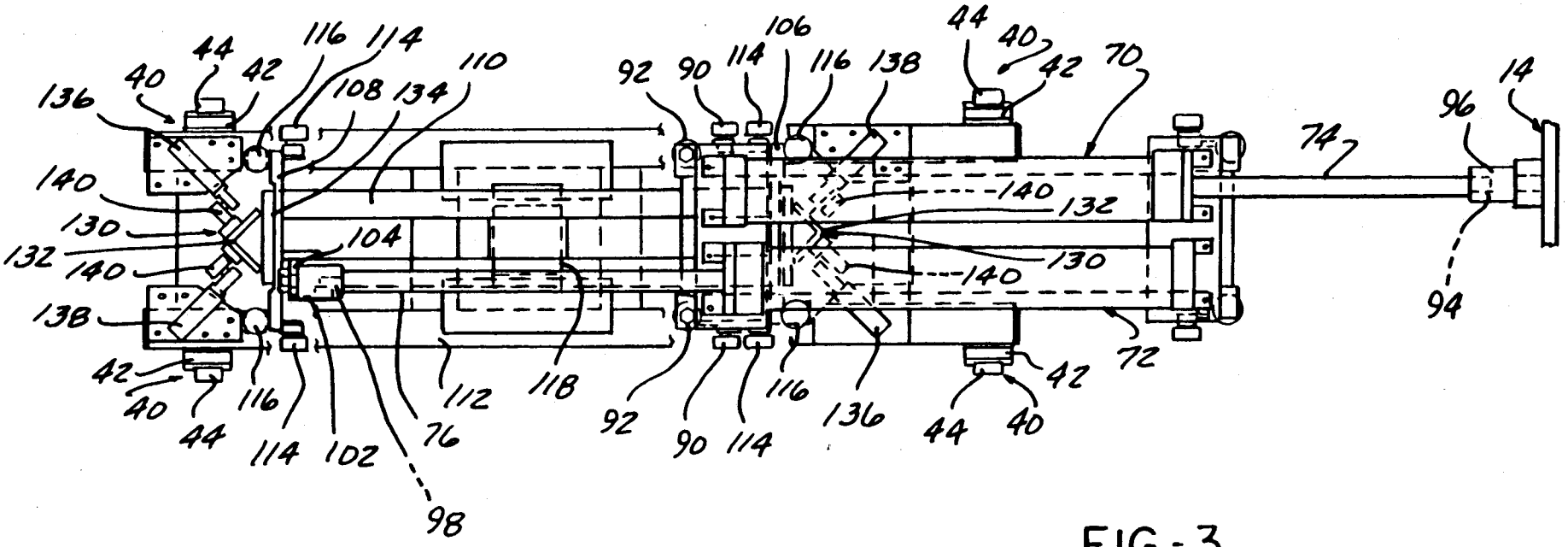
FIG. 3 is a plan elevational view of the parts transfer apparatus shown in FIG. 1.

As shown in FIG. 2, the outer end 94 of the first cylinder rod 74 is fixedly connected via a suitable mounting connection 96 to a portion of the rigid support structure surrounding the frame 30. The fixed connection 96 between the rigid support structure 14 and the outer end 94 of the first cylinder rod 74 may be any suitable connection, such as welding or, preferably, a threaded interconnection between threads on the outer end 94 of the first cylinder rod 74 which engage threads in a mounting collar 96 attached to the rigid support structure 14.

Figure 6:
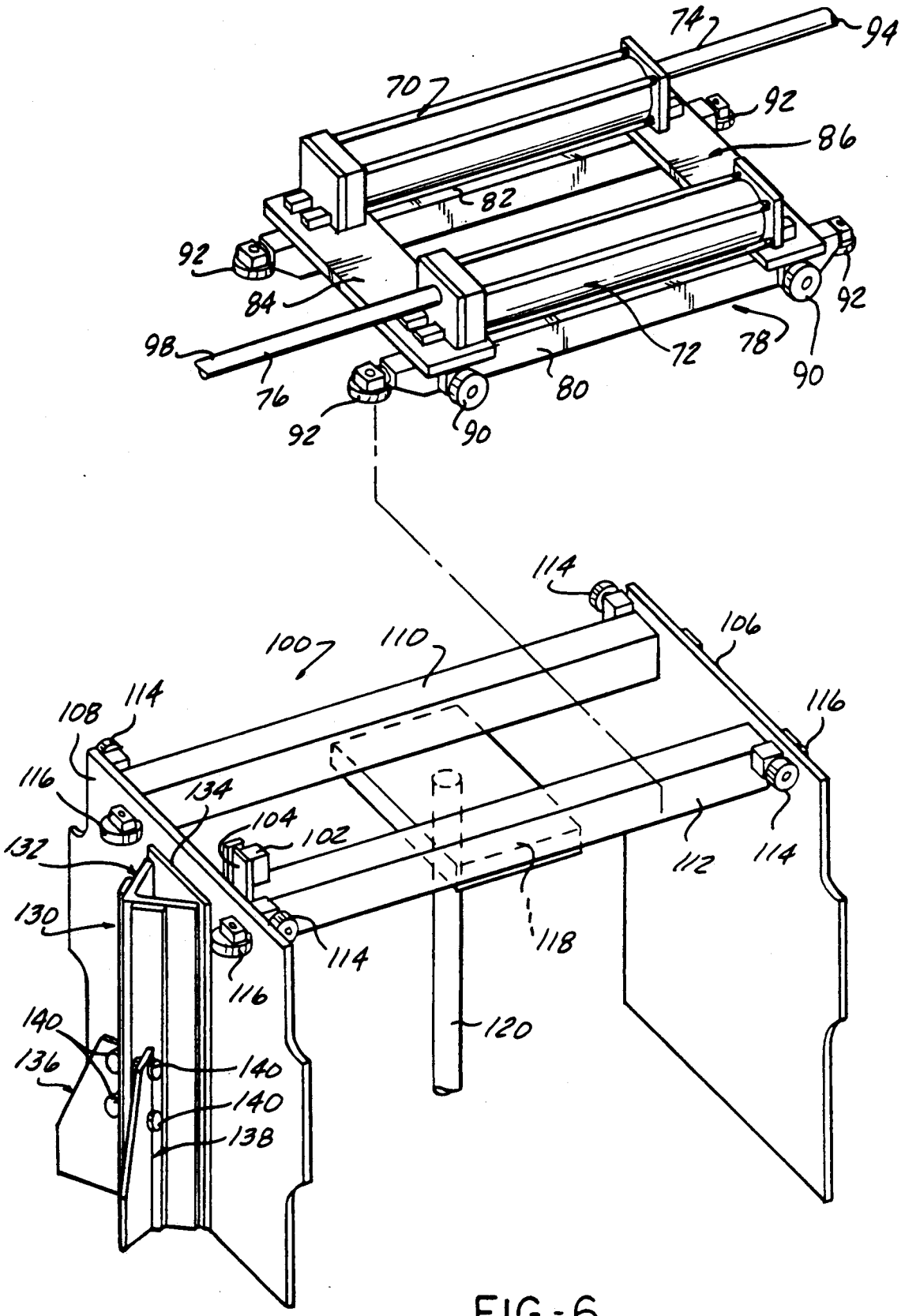
FIG. 6 is an exploded, perspective view showing the first and second carts and drive means of the present invention.

Similarly, the outer end 98 of the second cylinder rod 76 is fixedly connected to a second cart denoted in general by reference number 100 in FIGS. 2 and 6. The outer end 98 of the second cylinder rod 76 is connected via a mounting collar 102 which is fixedly connected to a bracket 104 attached to a plate on the second cart 100.

The second cart 100 is also movably disposed with respect to the rigid support structure 14. The second cart 100 includes opposed vertically extending end plates 106 and 108 which are secured, such as by welding, to spaced longitudinally extending tubular members 110 and 112. Roller pairs formed of a vertically oriented roller 114 and a horizontally oriented roller 116 are mounted at each corner of the second cart 100 for movably mounting the second cart 100 to the spaced platform members 22 and 24 of the rigid support assembly as shown in FIG. 4. Each of the rollers 114 and 116 is connected to the end plates 106 or 108 via mounting brackets. It should be noted that, as shown in FIGS. 1 and 2, the first and second carts 70 and 100, respectively, are mounted on the rigid platform members 22 and 24 of the support structure 14 such that the roller pairs adjacent the end plate 84 on the first cart 70 are disposed between the roller pairs mounted on the end plates 106 and 108 of the second cart 100. This enables the independent, sequential movement of the first and second carts 70 and 100, as described in greater detail hereafter.

The second cart 100, as shown in FIG. 6, also includes a mounting plate 118 which fixedly receives one end of a reciprocal cylinder rod 120 of a counterbalance means or cylinder 122 shown in FIG. 2. The counterbalance cylinder 122 assists vertical movement of the frame 30 as the frame 30 reciprocates between the first and second ends of the rigid support structure 14. The counterbalance cylinder 122 is fixedly mounted to the frame 30 via a suitable mounting plate or bracket, as shown in FIG. 2. One or more counterbalance cylinders 122 may be employed, as shown in FIG. 1, depending on the weight of the frame 30 and the workpieces 12.

Guide means denoted in general by reference number 130 are provided for controlling the vertical movement of the frame 30, as described hereafter. Each of the guide means 130 is mounted on one of the end plates 106 and 108 of the second cart 100. Each of the guide means 130 comprises a V-shaped member 132 having perpendicularly disposed, vertically extending legs. The ends of the legs of the V-shaped member 32 are attached, by welding, to a mounting plate 134 which is itself attached to one of the end plates 106 or 108 of the second cart 100.

Two support brackets 136 and 138 are mounted on tubular members forming opposed sides of the frame 30, as shown in FIGS. 2 and 4. The support plates 136 and 138 each carry a pair of rollers 140 which slidingly engage respective ones of the legs of the V-shaped member attached to the end plates 106 or 108 of the second cart 100.

Referring again to FIG. 1, the cam lift and carry parts transfer apparatus 10 of the present invention also includes workpiece engaging means denoted in general by reference number 150. The workpiece engaging means 150 may comprise any suitable clamp, gripper, etc., which is movable between an open position spaced from the workpiece 12 and a closed position engaging and securely contacting the workpiece 12. One or more workpiece engaging means 150 may be disposed in each work station and arranged in spaced apart positions. Each of the workpiece engaging means 150 associated with one particular work station are connected to the frame 30 via a suitable structure denoted in general by reference number 152. The support structure 152 may take any form, such as a structural arrangement of tubular members, which rigidly interconnect the workpiece engaging means 150 and precisely locate the workpiece engaging means 150 in each work station through which the parts transfer apparatus 10 extends.

Not shown in FIG. 1 are a control means and solenoid operated valves which are employed to automatically open and close the workpiece engaging means 150 in a timed manner during the sequence of operation of the parts transfer apparatus 10. As such components are conventional and do not form a part of the present invention, the details of such control means are not provided.

Figure 7:
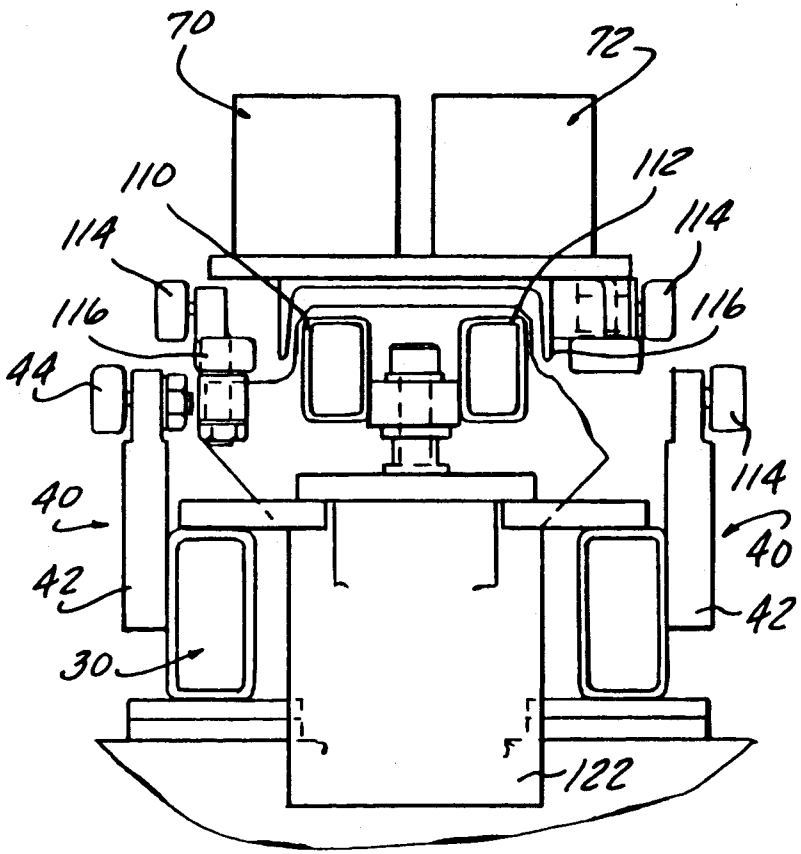
FIG. 7 is a partial, left hand end view showing the midpoint of travel of the parts transfer apparatus of the present invention.

The operation of one cycle of the cam lift and carry parts transfer apparatus 10 of the present invention will now be presented with regard to FIGS. 1 and 7. The parts transfer apparatus 10 is illustrated in FIG. 1 at its start position in which the frame 30 is located in a part pickup position with the workpiece engaging means 150 engaging workpieces 12 in each work station. Further, the first and second cylinder rods 74 and 76 of the first and second cylinders 70 and 72, respectively, are fully extended by control valves and control means, not shown.

First, the first cylinder 70 will be activated causing a retraction of the first cylinder rod 74 within the first cylinder 70. However, since the outer end 94 of the first cylinder rod 74 is fixedly connected to the rigid support structure 14 surrounding the movable frame 30, such retraction causes the first cylinder 70 to move to the right in the orientation shown in FIGS. 1 and 2. This movement of the first cylinder 70 is transmitted to movement of the first cart 78. Such movement of the first cart 78 also moves the second cylinder 72. However, since the valves attached to the fluid inlets and outlets of the second cylinder 72 are held in position, the fixed connection between the outer end 98 of the second cylinder rod 78 causes a simultaneous movement of the second cart 100 to the right.

Such initial movement of the first and second carts 78 and 100, respectively, causes the cam followers 40 attached to each corner of the frame 30 to traverse upward along the first inclined portion 60 of each of the first cams 50 and along a first portion or approximately one half of the second linear horizontal portion 62 of each of the first cams 50. The counterbalance cylinder 122 and the guide means 130 control the vertical component of movement of the frame 30 to affect both a vertical movement along with a simultaneous horizontal movement as the cam followers 40 traverse the first inclined portion 60 of the cams 50.

At the end of the full retraction of the first cylinder rod 72 in the first cylinder 70, the second cylinder 72 is activated causing a retraction of the second cylinder rod 76. During such retraction of the second cylinder rod 76, the first cylinder 70 is locked in position with the first cylinder rod 74 fully retracted therein. Such retraction of the second cylinder rod 76 causes the second cart 100 fixedly connected thereto and the frame 30 to move along the remainder of the second horizontally extending, linear portion 62 of the first cam 50 and into the third inclined portion 64 to the second end 58 of the first cams 50. This movement causes a continued linear movement of the frame 30 and a lowering of the frame 30 to a part setdown height.

This sequence of operation has been provided for the cam followers at the first end 32 of the frame 30. Simultaneous with such movement of the first end 32 of the frame 30, the cam followers 40 engaging the second cams 52 follow the same path along the second cams 52 such that both ends 30 and 32 of the frame 30 travel through the same path of movement.

When the frame 30 reaches the desired part setdown height, with both of the first and second cylinder rods 74 and 76 fully retracted in the first and second cylinders 70 and 72, respectively, the workpiece engaging means 150 will open thereby releasing each of the workpieces 12 onto locators in the support structure surrounding the frame 30, as shown in FIG. 1.

Next, the second cylinder 72 is activated to extend the second cylinder rod 76 causing a reverse movement of the second cart 100 and the frame 30 upward along the third inclined portion 64 of the cams 50 and 52 and along a first portion of the second linear portion 62 of each of the cams 50 and 52. At the completion of full extension of the second cylinder 76, the first cylinder 70 will be activated to extend the first cylinder rod 74 causing a continued movement of the first cart 78, the second cart 100 and the frame 30 along the second linear portion 62 of each of the cams 50 and 52 and downward along the first inclined portion 60 of each of the cams 50 and 52 to the start position.

In summary, there has been disclosed a unique cam lift and carry parts transfer apparatus which may be constructed at a lower cost than previously devised lift and carry shuttle apparatus having separate drive means for reciprocating, and raising and lowering the shuttle rails during each cycle of operation. The cam and cam follower means employed in the present parts transfer apparatus provides both vertical and horizontal components of movement thereby enabling a single drive means to control the entire lift and carry motion of the parts transfer apparatus. Further, the cams may be easily modified to effect any desired path of movement of the parts transfer apparatus. Specifically, the cams may be designed with different parts pickup and parts setdown heights to add versatility to the range of applications which may employ the parts transfer apparatus of the present invention to advantage.

What is claimed is:

1. A parts transfer apparatus for progressively advancing workpieces through successive work stations comprising:

a rigid support structure surrounding the work stations and having first and station ends;

a movable frame;

workpiece engaging means, mounted on the frame, for engaging a workpiece;

cam means fixedly mounted on the support structure and disposed on opposite sides of the frame, the cam means defining a reciprocal path of movement for the frame;

cam follower means mounted on the frame and engaging the cam means; and drive means, coupled to the support structure and the frame, for reciprocatingly driving the frame between the first and second ends of the support structure, wherein the drive means comprises:

first cart means movably mounted for horizontal bi-directional movement on the support structure;

a second cart movably mounted for horizontal bi-directional movement on the support structure, the movable frame being connected to the second cart for movement therewith; and first and second fluid operated cylinders, each having a reciprocal cylinder rod;

the first and second cylinders being fixedly mounted on the first cart means with the ends of the cylinder rod of the first cylinder fixedly connected to the support structure and extending outward from one end of the first cart means, the cylinder rod of the second cylinder extending outward in an opposite direction from the first cart means and fixedly connected to the second cart.

2. The parts transfer apparatus of claim 1 wherein the cam means comprises:

a first pair of identically-shaped cams disposed on opposite sides of one end of the frame; and a second pair of identically-shaped cams disposed on opposite sides of the other end of the frame, each cam of the second pair of cams being linearly arranged, end-to-end with one of the cams of the first pair of cams, each of the second pair of cams being identically shaped as the first pair of cams.

3. The parts transfer apparatus of claim 2 wherein each of the cams of the first and second pairs of cams comprises:

a first inclined portion extending upward from a first end;

a second linear, substantially horizontally extending portion extending from the first inclined portion; and a third inclined portion extending downward from the second linear portion.

4. The parts transfer apparatus of claim 3 wherein the cam follower means comprises:

a first pair of rollers disposed on opposite sides of a first end of the frame;

a second pair of rollers disposed on opposite sides of the second end of the frame;

the first pair of rollers engaging and moving along the first pair of cams; and the second pair of rollers engaging and moving along the second pair of cams.

5. The parts transfer apparatus of claim 1 further including:

a counterbalance cylinder having a reciprocal cylinder rod, the counterbalance cylinder being mounted on the movable frame with the exterior end of the counterbalance cylinder rod being fixedly connected to the second cart; and guide means, mounted on the second cart, for guiding the vertical movement of the frame.

* * * * *